United States Patent [19]

Iwayama et al.

[11] Patent Number: 4,595,426

[45] Date of Patent: Jun. 17, 1986

[54] GRAIN-ORIENTED SILICON STEEL SHEET AND PROCESS FOR PRODUCING THE SAME

[75] Inventors: Kenzo Iwayama; Yasunari Yoshitomi; Katsuro Kuroki, all of Kitakyushu, Japan

[73] Assignee: Nippon Steel Corporation, Tokyo, Japan

[21] Appl. No.: 709,419

[22] Filed: Mar. 7, 1985

[51] Int. Cl.[4] ..... C04B 35/00

[52] U.S. Cl. ..... 148/31.55; 148/31.5; 148/111; 75/123 L

[58] Field of Search ..... 148/31.5, 31.55, 111; 75/123 L

[56] References Cited

U.S. PATENT DOCUMENTS

| | | | |
|---|---|---|---|
| 2,242,234 | 5/1941 | Carpenter | 148/31.55 |
| 3,855,020 | 12/1974 | Salsgiver et al. | 148/31.55 |
| 3,954,521 | 5/1976 | Malagari | 148/31.55 |
| 3,959,033 | 5/1976 | Barisoni et al. | 148/31.55 |
| 4,014,717 | 3/1977 | Barisoni et al. | 148/31.55 |
| 4,108,694 | 8/1978 | Shiozaki et al. | 148/31.55 |

*Primary Examiner*—John P. Sheehan

*Attorney, Agent, or Firm*—Kenyon & Kenyon

[57] ABSTRACT

Extremely low watt-loss of $W_{17/50} \leqq 0.88$ w/kg is provided by the combination of extremely low carbon, silicon and nitrogen contents; a thin sheet thickness of 0.15 to 0.23 mm; a high magnetic flux density $B_{10} \geqq 1.89$ T; and copresence of coarse and fine (2 mm or less) grains, the distance ($\overline{ND}$) between the fine grains controlled to 2.0 to 8.0 mm.

3 Claims, 7 Drawing Figures

20mm

GRAIN-ORIENTED SILICON STEEL SHEET AND PROCESS FOR PRODUCING THE SAME

BACKGROUND OF THE INVENTION

1. Field of the Invention

The present invention relates to a grain-oriented steel sheet having a so-called {110}<001> Goss texture and used as core material for transformers and other electrical machinery and apparatus. The present invention also relates to a process for producing the grain-oriented silicon steel sheet.

2. Description of the Related Art

One of the recent trends in the production of electrical machinery and apparatus has been the increased use of silicon steels having lower watt loss, which may be representated by the expression $W_{17/50}$, i.e., energy lost under a magnetizing force of 17 kG at 50 Hz. In addition, endeavors have been made to improve magnetic flux density, which may be represented b $B_{10}$, i.e., the magnetic flux density under the application of a magnetizing force of 1000 A/m.

To improve the watt-loss characteristic, endeavors heretofore have been made to orient the crystal grains closely to the complete Goss orientation. In addition, attention has been paid to the crystal-grain size, resistivity, and the surface coating, all of which influence the watt-loss characteristic.

Nevertheless, there are only a few methods, at present, which can provide a low watt loss of $W_{17/50}<1.0$ w/kg. Further, these methods are either unsuited for industrial-scale operations or produce products unsuited for use for certain kinds of the electrical machinery and apparatus.

For example, one method proposes to increase the silicon content so as to raise the resistivity. This, however, impairs the workability. Thus, the maximum silicon content is restricted by the workability.

Other methods aim at improving the watt-loss characteristics by imparting a tensional force. Toward this end, Japanese Examined Patent Publication (Kokoku) No. 51-12451 discloses a method for improving the quality of a forsterite coating, and Japanese Examined Patent Publication No. 53-28375 discloses a method for top coating. While the tensional force can be increased with an increase in thickness of these coatings, the improvement attained by the effects of tensional force is restricted by the space factor of the transformer core as the space factor is lessened with the increase in the coating thickness. Still other methods aim at improving the watt-loss characteristics include the marking-off methods, disclosed in Japanese Examined Patent Publication No. 58-5968, and the laser-irradiation method, disclosed in Japanese Examined Patent Publication No. 58-26405. These, however, can only be applied for grain-oriented silicon steels which do not undergo stress-relief annealing, because the improvement attained by the marking-off and the like is lost by stress-relief annealing. Also well known as a method for watt-loss reduction is grain-refining. Japanese Unexamined Patent Publication (Kokai) No. 57-41326 discloses watt-loss reduction of thin sheets by grain-refining. The grain-refinement, however, generally makes a high magnetic flux density difficult, i.e., both a high magnetic flux density and low watt-loss cannot be obtained in the grain-refining method.

SUMMARY OF THE INVENTION

It is an object of the present invention to lessen the watt-loss at least 10%, as compared with $W_{17/50}\geqq 1.00$/kg attained by the prior art, by means of controlling the distribution state of small-sized crystal grains and, occasionally, controlling the unevenness degree of the grain boundaries, with regard to 0.15 to 0.23 mm thick grain-oriented silicon steel sheets having $B_{10}\geqq 1.90$ T.

It is a further object of the present invention to provide a process for producing a grain-oriented electrical steel sheet having a low watt-loss.

In accordance with an aspect of the present invention, there is provided a grain-oriented silicon steel sheet containing from 2.3% to 4.3% silicon and 0.0020% or less of each of carbon, nitrogen, and sulfur and having a sheet thickness of from 0.15 to 0.23 mm, wherein crystal grains having 2 mm or less circle-equivalent diameter are present in an amount of from 15% to 70% by area based on the total crystal grains; and, further an average value of nearest inter-grain distance ($\overline{ND}$) of the crystal grains of 2 mm or less is from 2.0 to 8.0 mm ($\overline{ND}$=2.0 to 8.0 mm); and $B_{10}\geqq 1.89$ T and $W_{17/50}\leqq 0.88$ w/kg.

In accordance with another aspect of the present invention, there is provided a process for producing such a grain-oriented silicon steel sheet characterized by hot-rolling a starting material consisting of from 0.02% to 0.10% carbon, from 2.3% to 4.3% silicon, from 0.04% to 0.4% tin, from 0.015% to 0.040% acid soluble aluminum (an inhibitor element), from 0.0040% to 0.0100% nitrogen, from 0.030% to 0.150% manganese, from 0.015% to 0.04% sulfur, and iron and impurities in balance; annealing and preliminarily cold rolling the hot-rolled sheet, if necessary; heat-treating, prior to final cold-rolling, by (a) holding a temperature range of from 900° C. to 1200° C. for 10 to 600 seconds or (b) holding a temperature range of from 1050° C. to 1200° C. for 300 seconds or less, followed by cooling down to 100° C. in a time of 5 to 50 seconds; pickling; finally cold-rolling at a screw-down ratio of from 81% to 93%, thereby obtaining a cold-rolled sheet having a final thickness of from 0.15 to 0.23 mm; decarburization-annealing; applying on the sheet surface an annealing separator mainly composed of MgO; and finish-annealing.

DESCRIPTION OF THE PREFERRED EMBODIMENTS

Figure 1:
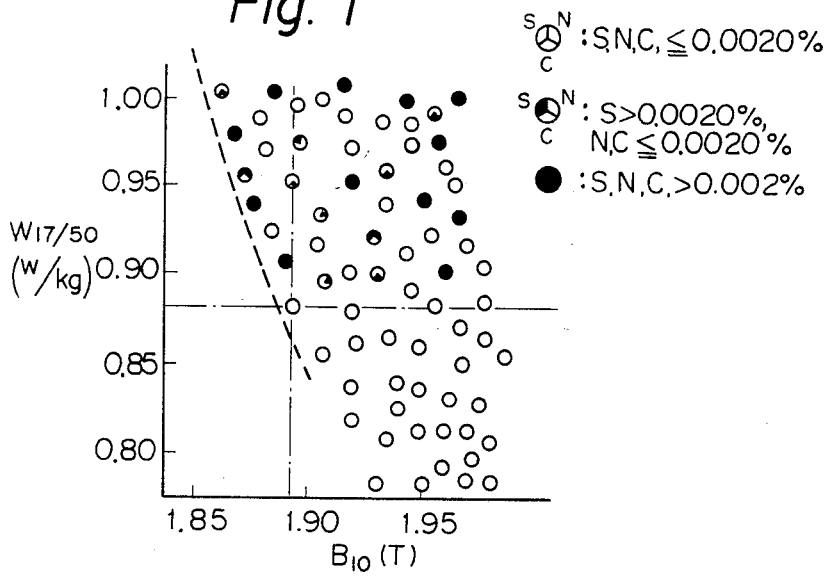
FIG. 1 is a graph showing the relationship between $B_{10}$ and $W_{17/50}$.

The 0.15 to 0.23 mm thick grain-oriented electrical steel sheet of the present invention is thinner than conventional ones and thus has the disadvantage of lower productivity, but it is very advantageous at an energy-saving material for electrical machinery and apparatuses. When the silicon steel according to the present invention is used as the core of a transformer under uninterrupted operation, the few percent of power saved accumulates and results in considerable savings.

The first requirement for the product relates to its components and is that the content of silicon be from 2.3% to 4.3% and the content of each of carbon, nitrogen, and sulfur, as impurities, be restricted to 0.0020% or less. The above contents are critical for obtaining $W_{17/50} \leqq 0.88$ w/kg. Such a content of silicon and impurities has hithertofore been recognized as effective for decreasing the eddy-current loss and hysteresis loss, however, that recognition was qualitative and did not establish the quantitative knowledge to reduce the $W_{17/50}$ to 0.88 w/kg or less.

The second requirement is that the sheet thickness of the grain-oriented silicon steel sheet be from 0.15 to 0.23 mm. It has heretofore been broadly known that the eddy-current loss characteristic can be improved by reducing the sheet thickness. Nevertheless, $W_{17/50} \leqq 0.88$ w/kg cannot be attained simply by reducing the sheet thickness of conventional grain-oriented silicon steel sheets.

The third requirement is a magnetic flux density of $B_{10} \geqq 1.89$ T. If the magnetic flux density $B_{10}$ is less than 1.89, the absolute value of the eddy-current loss is increased and, hence, a watt-loss $W_{17/50} \leqq 0.88$ w/kg cannot be attained regardless of the other conditions.

The fourth requirement is the crux of the present invention and involves a novel physical parameter based on a principle, i.e., a dispersive location of grains having a specified size, different from those heretofore known.

Specifically, the fourth requirement is that 2 mm or less circle-equivalent diameter crystal grains are present in the product in an amount of from 15% to 70% by area and, further, the average nearest intergrain distance ($\overline{ND}$) of the 2 mm or less circle-equivalent diameter grains is from 2.0 to 8.0 mm. In this regard, the "circle equivalent diameter" means the diameter of a circle which has the same area of a crystal grain. The "nearest intergrain distance (ND)" means the minimum value of the distance between the centers of the 2 mm or less circle equivalent crystal grains. The "average nearest intergrain distance ($\overline{ND}$)" means the average values of the nearest intergrain distance (ND) which are measured for each 2 mm or less diameter grain. The physical significance of $\overline{ND}$ is explained later.

The above four requirements are all necessary for attaining the objects of the present invention. That is, if any one of the requirements is not fulfilled, the objects of the present invention cannot be attained.

The present inventors first developed a method allowing them to observe the secondary recrystallized structure (hereinafter referred to as the "macrostructure") of grain-oriented silicon steel sheets. The method developed was to heat and corrode the product in an aqueous hydrochloric acid solution. This removed the surface coating, such of the forsterite coating, and made the macrostructure easily discernible.

The present inventors then conducted extensive experiments to produce a number of the 0.10 to 0.35 mm thick grain-oriented silicon steel sheets. These sheets were produced not only by known methods but also by test methods in which the composition of the silicon steels and the production conditions were varied in an attempt to attain a $W_{17/50} \leqq 0.88$ w/kg.

The present inventors took note of the fact that the watt-loss is lessened when the sheet thickness is small. This relationship has been previously known. The watt-loss reduction is attributable to the reduction in size of the macrostructure.

The present inventors also noted that some of the experimental results could not be explained by the previously known relationship. In other words, there were a member of inconsistencies when trying to explain why a low watt-loss is obtained under a particular size of macrostructure.

The present inventors then determined that a substantial amount of the data was related to the location of coarse and fine grains of the macrostructure.

The present inventors tried to quantitatively define the location of coarse and fine grains of the macrostructure. They subjected the steel sheets described above to data-processing by means of an image analyzing processor connected to a commercial computer. This image analyzing processor was of the type which has recently come into use for research and experiments in the metallurgical field and was used for obtaining the circle-equivalent diameter, its distribution graph, and, the average nearest intergrain distance ($\overline{ND}$) of n-mm circle-equivalent diameter crystal grains, "n" being a predetermined minimum value. They also carried out a chemical analysis of samples to obtain the residual amounts of carbon, nitrogen, and sulfur.

The present invention is now explained with reference to the drawings. FIG. 1 shows the $B_{10}$ and $W_{17/50}$ of the products produced in the extensive experiments and having $W_{17/50} < 1.00$ w/kg. The steels of the products contained from 2.3% to 4.3% of silicon, from 0.0002% to 0.0057% of carbon, from 0.0003% to 0.0046% of nitrogen, and from 0.0003% to 0.0038% of sulfur. The components of films were excluded for the determination of these contents. The products had only a forsterite coating or a forsterite coating and a tension-coating applied thereon. It is apparent from FIG. 1 that in order to obtain $W_{17/50} \leqq 0.88$ w/kg, $B_{10} \geqq 1.89$ T is necessary. From this viewpoint, the inventors numerically limited $B_{10}$ to be at least 1.89 T.

Figure 2:
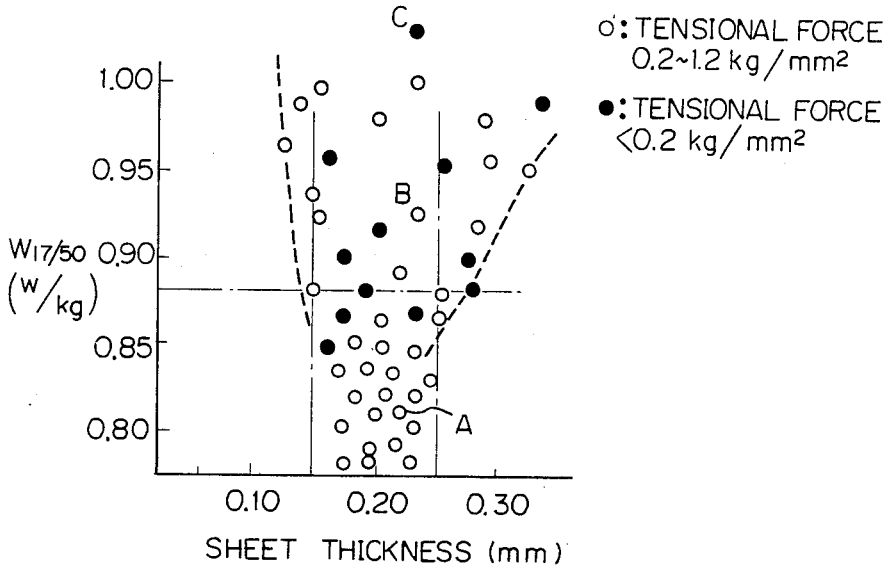
FIG. 2 is a graph showing the relationship between sheet thickness and $W_{17/50}$.

As also apparent from FIG. 1, each of the sulfur, nitrogen, and carbon contents must be 0.0020% or less in order to obtain $W_{17/50} < 0.88$ w/kg. Within the range of the silicon content of the products tested, a high silicon content generally results in a low watt-loss. When the silicon content is the lowest value of 2.3%, the watt-loss $W_{17/50}$ exceeds 0.88 w/kg with regard to several samples. With regard to 2.3% silicon samples exhibiting less than 0.88 w/kg, such properties other than the silicon content, such as the sheet thickness, magnetic flux density, and tensional force fall within preferred ranges. Then, the relationship between the sheet thickness and $W_{17/50}$ was investigated with regard to products fulfilling the first and third requirements. The results are shown in FIG. 2. As is apparent from FIG. 2, a sheet thickness of from 0.15 to 0.23 mm is necessary for obtaining $W_{17/50} \leqq 0.88$ (the first requirement).

Figure 3:
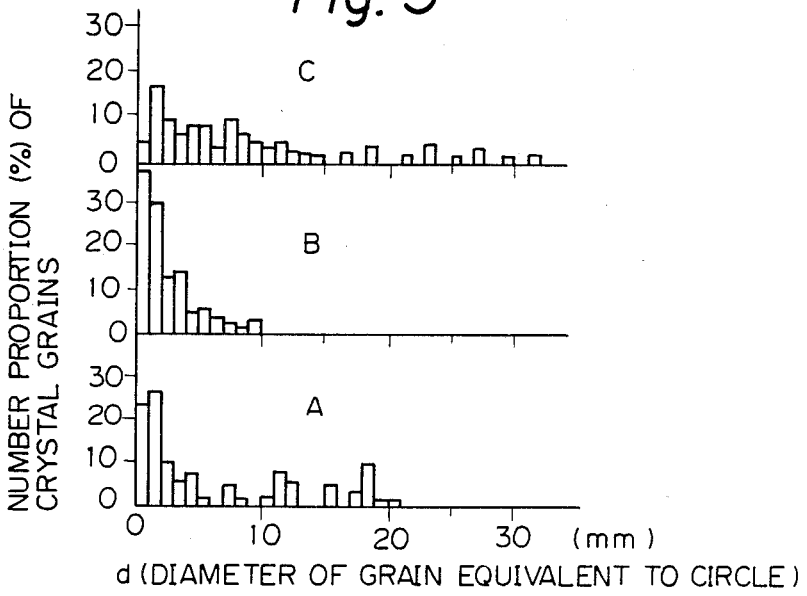
FIG. 3 is a graph showing the relationship between "d", which is the circle-equivalent diameter of the macrostructure of Samples A, B, and C, obtained by the macrostructure analysis, and a percentage of the number of the d (mm) circle-equivalent diameter crystal grains.

The objective watt-loss of $W_{17/50} \leqq 0.88$ may occasionally not be obtained even by fulfilling the above three requirements. In order to determine further requirements, the inventors selected samples A, B, and C (FIG. 2), having a sheet thickness of approximately 0.21 mm and fulfilling the first and third requirements, from the samples shown in FIG. 2 and measured the circle-equivalent diameter (d) of individual grains and counted the number of grains having the diameter (d) by means of an image-analyzing processor. The percentage proportion of the grains with the various circle-equivalent diameters (d) is shown in FIG. 3.

In sample A, which had $W_{17/50} \leqq 0.88$ w/kg, 2 mm or less circle-equivalent diameter crystal grains accounted for 43% of the total grains. Notwithstanding the relatively large number of fine grains, there were also relatively coarse grains approximately 10 mm to 20 mm in size. The presence of the relatively coarse grains is believed to be due to the high $B_{10}$ of sample A, as described hereinbelow. Thorough, detailed observation revealed the 2 mm or less circle-equivalent diameter crystal grains did not cluster, but were well dispersed and positioned between coarse grains. The nearest intergrain distances (ND) between the 2 mm or less circle-equivalent diameter crystal grains were almost constant.

In sample B, which had a $W_{17/50}$ of 0.92 w/kg, the 2 mm or less circle-equivalent diameter crystal grains accounted for 57% of the total grains. The largest grains were 10 mm in size and no coarse grains were present. Thorough, detailed observation of the macrostructure revealed a few 2 mm or less circle-equivalent diameter crystal grains clustered with each other.

In sample C, which had the lowest $W_{17/50}$, the 2 mm or less circle-equivalent diameter crystal grains accounted for only slightly less than 20%. Coarse grains, such as 30 mm circle-equivalent diameter crystal grains, were also present.

Consideration of the grain distribution as outlined above revealed that the proportion of 2 mm or less circle-equivalent diameter crystal grains and the dispersion stage of such grains are important for providing a low watt-loss. Accordingly, the inventors measured the centers of gravity of the 2 mm or less circle-equivalent diameter crystal grains and then measured the distances between the nearest centers of gravity, i.e., the average nearest intergrain distance ($\overline{ND}$) by using the image-analyzing processor. The results are shown in Table 1.

obtaining $W_{17/50} \leqq 0.88$ w/kg. The present inventors made further extensive experiments and obtained a number of products under production conditions which easily attained the first, second, and third requirements in order to clarify the relationship between $W_{17/50}$ and the average nearest intergrain distance ($\overline{ND}$). With regard to the first requirements, the conditions in the decarburizing step and the finishing annealing step were adjusted to thoroughly decarburize, denitride, and desulfurize the steel. The second requirement was met by setting the sheet thickness of all of the test samples in the range of from 0.15 to 0.23 mm.

With regard to the third requirement, to easily provide $B_{10} \geqq 1.89$ T, the steels were produced by melting and AlN was used as the inhibitor. Annealing followed by quenching was carried out before the final cold-rolling. The reduction at the final cold-rolling was 81% or more.

Figure 4:
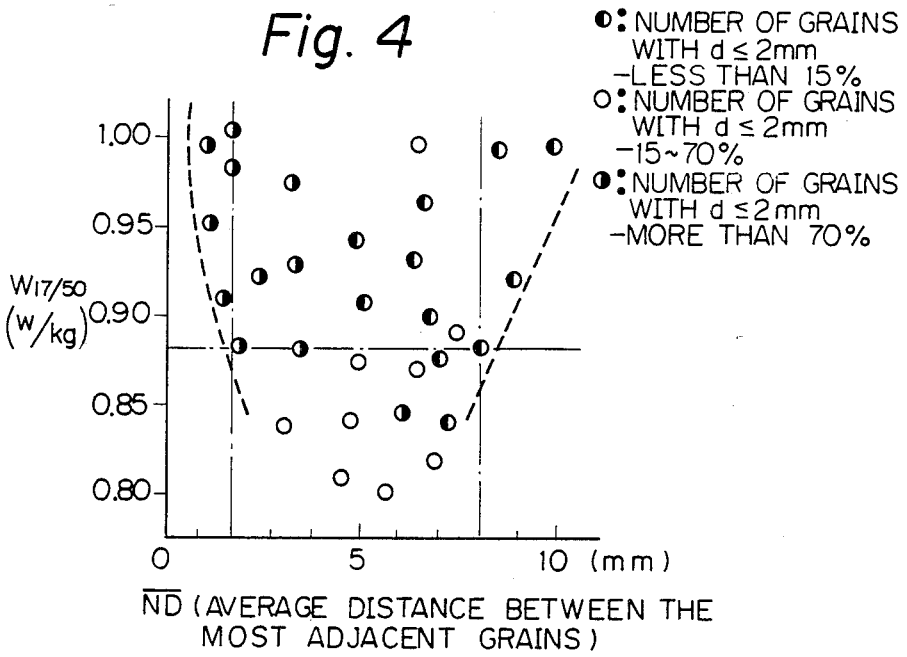
FIG. 4 is a graph showing the relationship between the average nearest intergrain distance ($\overline{ND}$) and $W_{17/50}$, also showing the proportion of fine grains as a parameter.

FIG. 4 shows the relationship between $W_{17/50}$ and the average nearest intergrain diameter ($\overline{ND}$) with regard to the samples fulfilling the first, second, and third requirements. In FIG. 4, the data is classified into three groups based on the circle-equivalent diameter (d). These groups were determined by several preliminary investigations on the influence of the circle-diameter equivalent (d) upon the watt-loss. The preliminary investigations revealed that when 2 mm or less circle-equivalent diameter crystal grains are present in an amount of from approximately 15% to 70%, the watt-loss characteristic is improved.

It is clear from FIG. 4 that, for the fourth requirement, $\overline{ND}$ should be from 2 to 8 mm and the 2 mm or less circle-equivalent diameter grains should be present from 15% to 70%.

Now, consideration is given to why an improved watt-loss characteristic can be attained by fulfilling the above four requirements. Investigations by the present inventors on the grain orientation in individual grain-oriented silicon steel sheets showed that, generally, large-diameter grains include a greater number of grains closely oriented to the {110}<001> direction as compared to small-diameter grains; the deviation of small-diameter grains from the {110}<001> direction is generally great; and the width of magnetic domains of large-diameter grains is generally great as compared with that of small-diameter grains. Such a difference in the width of magnetic domains appears to result not only from the difference in the grain orientation but also from the stress at the grain boundaries.

The grain boundaries of small-diameter grains appears to act as sites of strain and hence subdivide the magnetic domains. When each small-diameter grains is surrounded by large-diameter grains, even the magnetic domains of the large-diameter grains are subdivided due to the strain generated at the grain boundaries of the

TABLE 1

| Samples | | Components (%) Si | C | N | S | Sheet Thickness (mm) | Tensional Force of Film (kg/mm²) | $B_{10}$ (T) | $W_{17/50}$ (W/kg) | Measurement Data of Macroscopic Shape: $\overline{d}$ (mm) | Proportion (%) of Grains with d ≦ 2 mm | $\overline{ND}$ (mm) |
|---|---|---|---|---|---|---|---|---|---|---|---|---|
| Inventive Method | A | 3.4 | 0.0013 | 0.0007 | 0.0009 | 0.22 | 0.81 | 1.94 | 0.82 | 6.7 | 43 | 4.8 |
| Known Method | B | 3.5 | 0.0009 | 0.0007 | 0.0006 | 0.21 | 0.79 | 1.91 | 0.92 | 2.3 | 57 | 1.7 |
| | C | 3.4 | 0.0011 | 0.0006 | 0.0008 | 0.22 | 0.82 | 1.94 | 1.05 | 8.5 | 19 | 9.1 |

As is understood from Table 1, it is difficult to obtain $W_{17/50} \leqq 0.88$ w/kg when the $\overline{ND}$ has a small value (sample B) or a large value (sample C).

The considerations as described above revealed that the distribution state of fine grains was important for small-diameter grains. When the forsterite or tension coatings for imparting tension to a steel sheet are applied on the steel sheet, the subdivision as described above can be particularly enhanced. The large-diameter grains have a high $B_{10}$, due to their close orientation to the {110}<001> direction. When the magnetic domains of such grains are subdivided, the watt-loss characteristic is drastically improved.

The small thickness according to the present invention appears to make the coatings, such as forsterite and tension coatings, more effective than in the case of thick grain-oriented silicon steel sheets.

The present inventors investigated and experimented with other requirements aside from the four requirements so as to further lessen $W_{17/50}$. As a result of their investigations and experiments, the present inventors discovered two additional requirements for obtaining an extremely improved watt-loss. These requirements are defined by an SF value and the tension value and are indispensable for obtaining $W_{17/50} < 0.86$ w/kg.

"SF" is an abbreviation of shape factor. The SF value is defined by:

$$SF \text{ value} = \frac{4\pi \times (\text{area of crystal grain})}{(\text{length of crystal grain boundary})^2}$$

The SF value indicates the shape of the grain boundary. When a crystal grain appears round on the surface of a steel sheet, the SF value is equal to 1. The SF value is therefore a parameter indicating the shape of the grain boundary, normalized by 1. The SF value because smaller as the grain boundary becomes more complicated. For example, when the shape of a crystal grain is hexagonal, the SF value is equal to 0.88.

Figure 6:
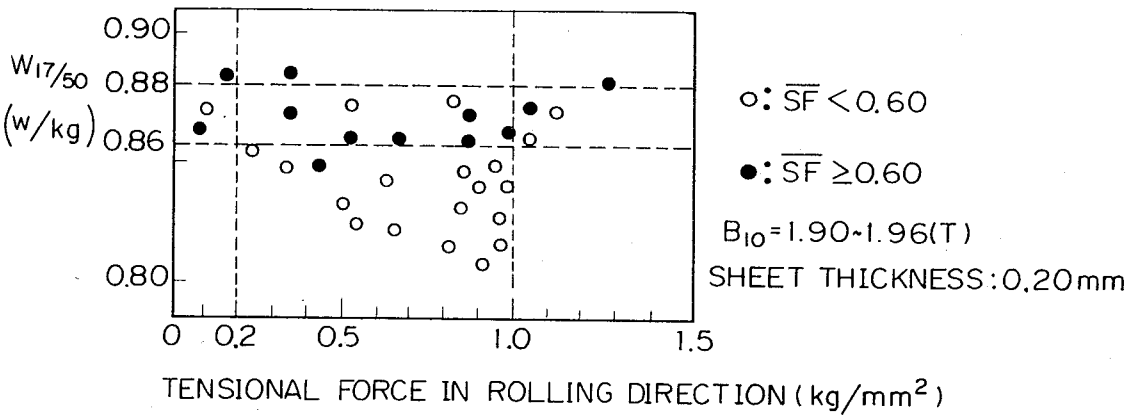

The present inventors conducted additional experiments similar to those for obtaining the results shown in FIG. 4. The data of samples which fulfilled the first to fourth requirements described above were further investigated with regard to $W_{17/50}$, the tensional force, and the SF value. The SF value was measured by means of an image-analyzing processor. The investigation results are shown in FIG. 6 with regard to 0.20 mm thick samples. In FIG. 6, the average SF value ($\overline{SF}$), which is obtained by taking the average SF over the crystal grains of a steel sheet, is shown.

As is apparent from FIG. 6, when $\overline{SF}$ is 0.60 or more, $W_{17/50} < 0.86$ w/kg is difficult to ensure, and there is no clear correlation between $W_{17/50}$ and the tensional force in the rolling direction. On the other hand, when $\overline{SF}$ is less than 0.60, $W_{17/50} < 0.86$ w/kg can be stably obtained and there is a clear correlation between the tensile force in the rolling direction and $W_{17/50}$, i.e., $W_{17/50}$ tends to lessen with an increase in the tensile force.

As is also apparent from FIG. 6, it is preferred that the tensile stress which is applied, before the stress-relief annealing, to a steel sheet, by a forsterite coating or tension coating be in the range of from 0.20 to 1.0 kg/mm$^2$.

One of the additional requirements is therefore $\overline{SF} < 0.60$. The other additional requirement is therefore a tensional stress of from 0.20 to 1.0 kg/mm$^2$. How these requirements influence the watt-loss is not clear, but is considered as follows. In high-magnetic flux density grain-oriented silicon steel sheets, each crystal grain has a difference in orientation at the grain boundaries. Such a difference is approximately 4° to 5° at the maximum. When such grain boundaries are subjected to tensional force, strain sites generate at the grain boundaries and their vicinity. The strain at the strain sites become great when the shape of the grain boundaries is intricate, that is, the SF value is small. The strain sites therefore effectively lessen the width of the magnetic domains when the SF value is small. As a result, the eddy-current loss and, thus, the total power loss, are lessened.

Now, an explanation is made of the process and production conditions for producing a grain-oriented silicon steel sheet which fulfills the first to fourth requirements.

Regarding the composition, the essential components of the starting material are from 2.3% to 4.3% of silicon, from 0.02% to 0.10% of carbon, from 0.015% to 0.040% of acid-soluble aluminum, and from 0.0040% to 0.0100% of nitrogen. These components are contained in the starting material. The acid-soluble aluminum and nitrogen act as inhibitors.

Silicon is an element for outstandingly improving the eddy-current loss. When the silicon content is less than 2.3%, the transformation phase is disadvantageously formed during the finishing annealing, so that the secondary recrystallization becomes difficult. When the silicon content is more than 4.3%, the steel drastically embrittles. Silicon concentrates, during the finishing annealing, on the surface of a steel sheet and is included in the oxides, such as forsterite. The silicon content of the steel is therefore decreased as compared with that of the starting material, generally, in an amount of from 0.1% to 0.2%.

When the carbon content is less than 0.02%, the amount of deformation phase, which is formed until the decarburization annealing, becomes too small to obtain good primary-recrystallized grains. On the other hand, if the carbon content is more than 0.10%, the decarburization property is impaired. The carbon content is therefore from 0.02% to 0.10%.

Aluminum and nitrogen are used in the present invention as the principal inhibitor elements, since the AlN inhibitor makes it possible to easily obtain a macrostructure in which coarse grains having a high $B_{10}$ and fine grains are present. When the content of acid-soluble aluminum is less than 0.015%, and, further, the nitrogen content is less than 0.0040%, an appreciable amount of AlN effective as the inhibitor cannot be ensured. On the other hand, when the content of acid-soluble aluminum is more than 0.040% and the nitrogen content is more than 0.0100%, the acid-soluble aluminum and nitrogen are solid-dissolved insatisfactorily.

Other known inhibitor elements, for example, 0.04% or less of sulfur and selenium and 0.4% or less of one or more of magnesium tin, antimony, arsenic, bismuth, and copper may be additionally contained in the starting material. When these elements exceed the maximum limits, the growth of secondary recrystallized grains is retarded.

A hot-rolled steel plate which fulfills the composition requirements described above is the starting material for producing a grain-oriented silicon steel sheet. The hot-rolled steel plate is annealed, if necessary, and cold-rolled appropriately. The annealing before the final cold-rolling is carried out with the plate held at 900° C. to 1200° C. for 10 to 600 seconds, or 1050° C. to 1200° C. for 300 seconds or less followed by being held at 800° C. to 1000° C. for 30 to 500 seconds, and cooling down to 100° C. in 5 to 50 seconds. The annealing step before the final cold-rolling is important for finely dispersing the inhibitor, thereby enhancing $B_{10}$. This step is also important for providing a condition of steel matrix appropriate for improved shape and distribution of crystal grains in the finishing annealing step. In the case of annealing at 900° C. to 1200° C. for 10 to 600 seconds, the lowest temperature of 900° C. and the shortest time of 10 seconds are determined for preventing incomplete precipitation of the inhibitor.

The highest temperature of 1200° C. and the longest time of 600 seconds are determined for facilitating uniform and fine inhibitor phases. The annealing pattern of 1050° C. to 1200° C. for 300 seconds or less and then 800° C. to 1000° C. for 30 to 500 seconds is particularly advisable for steel having a high silicon content, since the holding is first carried out for a short period of time at a temperature of from 1050° C. to 1200° C., which is effective for decomposing $Si_3N_4$, and then AlN and other inhibitors are precipitated in the latter holding.

The conditions of cooling after the holding are also important for stable secondary recrystallization and ensuring the magnetic properties. When quenching down to 100° C. for a time less than 5 seconds, the secondary recrystallization at the final production step is not attained. On the other hand, when the cooling rate is slower than cooling in still air, it is difficult to obtain the 2 mm or less circle-equivalent diameter grains. A cooling time more than 50 seconds is disadvantageous, since it becomes difficult to obtain products having a high magnetic flux density.

The annealed sheet is pickled so as to sufficiently remove the scale formed on the sheet surface and completely expose the sheet surface. The degree of removal of scale must be higher than in the conventional methods for producing a grain-oriented silicon steel sheet. The reason is not clear. Anyway, the growth of secondary recrystallization is considerably impeded, in the case of insufficient scale removal, when the sheet-thickness is thin.

The preferred thickness of the hot-rolled steel strip is in the range of from 1.6 to 2.5 mm. The optimum thickness varies in this range depending upon the silicon content, number of cold-rolling steps, and the sheet thickness of the product. For example, when the silicon content is more than 3.5%, the hot-rolled steel strip is desirably thin in the light of the bending embrittlement. When the product is thin, such as approximately 0.15 mm, double-stage cold-rolling is carried out and the hot-rolled steel strip must have a thickness enabling the double-stage cold-rolling.

In the final cold-rolling, a final thickness of from 0.15 to 0.23 mm is obtained. The screw-down degree at the final cold-rolling is from 81% to 93%. If the screw down degree is less than 81%, $B_{10} \geqq 1.89$ T is difficult to obtain. On the other hand, if the screw-down degree is more than 93%, stable secondary recrystallization becomes difficult.

The known decarburization annealing is then carried out at a temperature of from 800° C. to 860° C. Usually, the decarburization-annealing time is short when the sheet thickness is thin. However, in the present invention, a decarburization-annealing time longer than the usual time is preferred so as to decrease the carbon content to a level not detrimental to the magnetic properties.

An annealing separator mainly composed of MgO is then applied on the decarburization-annealed sheet surface, and the finishing annealing is carried out at a temperature of 1150° C. or more for 10 hours or more.

The soaking time of the finishing annealing is preferably 30% to 50% longer than the conventional one so as to thoroughly purify nitrogen and sulfur.

If necessary, a tension coating is applied on the grain-oriented silicon steel sheet. The heating for baking of the tension coating must be very carefully carried out so as not to generate thermal strain in the steel sheet, because, due to the thin sheet-thickness, any temperature-nonuniformity, especially during cooling, occasionally results in compression stress in parts of a steel sheet. The watt-loss is considerably impaired due to compression stress.

Incidentally, when the content of acid-soluble aluminum is 0.027% or more in the steel strip, the decarburization-annealed steel strip is advisably held at a temperature range of from 900° C. to 1100° C. for a time period of from 1 to 1000 seconds. This heat-treatment considerably mitigates the destablization of secondary recrystallization of the thin, 0.15 to 0.23 mm thick sheet product by the thin sheet thickness. This heat-treatment thus makes it possible to easily obtain a high $B_{10}$ value. It appears that, since the temperature of this heat treatment is higher than the decarburization-annealing temperature, the primary recrystallized grains are rectified and rather stabilized. However, if the temperature is excessively high and the time is excessively long, the inhibitor deteriorates and thus the secondary recrystallization becomes difficult.

Figure 5A:
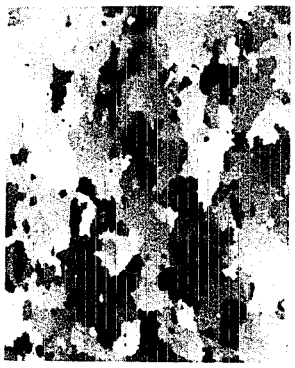
FIGS. 5(A) and 5(B) show the macrostructure of the material according to the present invention and of a comparative material, respectively; and, FIG. 6 is a graph showing the relationship between the tensional force in the longitudinal direction and $W_{17/50}$ and also showing the shape factor (SF) as a parameter.
Figure 5B:
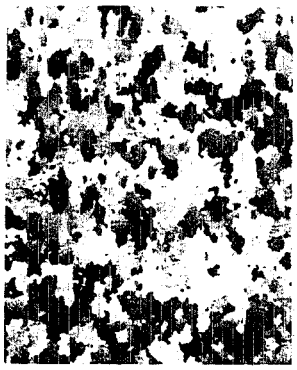

FIG. 5A shows the macrostructure of the product produced by the above-described process. FIG. 5B shows the macrostructure of the product produced by a conventional process. Particulars of these products follow:

| Product of Invention (A) | Conventional Product (B) |
|---|---|
| $\overline{ND}$ = 4.3 mm | $\overline{ND}$ 1.5 mm (<2.0 mm) |
| $W_{17/50}$ = 0.82 w/kg | $W_{17/50}$ = 0.97 w/kg |
| Si = 3.4%, $B_{10}$ = 1.93 T | Si = 3.4%, $B_{10}$ = 1.90 T |
| Sheet Thickness = 0.20 mm | Sheet Thickness = 0.20 mm |
| Tensional Force of Coating = 0.7 kg/mm$^2$ | Tensional Force of Coating = 0.7 kg/mm$^2$ |

As is apparent from FIGS. 5A and 5B, fine and coarse grains are dispersed and fine grains are separated from each other by coarse grains in the product of present invention (FIG. 5A), while the fine grains cluster in the conventional product (FIG. 5B).

Imposition of a production condition related to heat-treatment between the cold-rolling passes is effective for further lessening the watt-loss. In this case, the final cold-rolling step is carried out at a screw-down ratio of from 81% to 93% so as to obtain the sheet thickness of from 0.15 to 0.23 mm. Between the passes of the final cold-rolling step, heat-treatment of the steel strip is carried out at least twice by heating it to a temperature range of from 150° C. to 300° C. for 30 seconds or more. Heat-treatment carried out under the conditions described above considerably facilitates an $\overline{SF}$ of less than 0.60. The maximum passes of the final cold-rolling step are eight from a practical point of view, since more passes are wasteful.

The present invention is hereinafter explained by way of examples.

EXAMPLE 1

Five ingots were produced by a vacuum-melting furnace. The ingots contained silicon in an amount of from 1.1% to 3.6%, carbon in an amount of from 0.0055% to 0.071%, and different amounts of acid-soluble aluminum, nitrogen, manganese, sulfur, and selenium. The principal inhibitor was AlN.

The ingots were heated to 1350° C. and then hot-rolled to a sheet-thickness of 2.0 mm. The composition of hot-rolled sheets is shown in the left column of Table 2. The hot-rolled sheets were divided into two groups X, Y, for each charge. The hot-rolled sheets of the Y group were pickled. The hot-rolled sheets of the X, Y groups were cold-rolled to a thickness of 1.4 mm and subsequently loaded into a furnace, the temperature of which was set at 1140° C. As soon as the temperature of the steel sheets rose to 1135° C., the steel sheets were loaded into a furnace, the temperature of which was set to 930° C. The steel sheets were kept in the furnace for 100 seconds and then immersed in hot water of 70° C. to cool. After the above steps, the steel sheets were further divided into U and V groups at to carry out two kinds of pickling. In the U group, the appearance of the steel sheets was checked in the course of pickling to detect the time at which the scale disappear. The pickling was carried out twice. In the V group, the pickling was carried out for a time period of approximately 7/10 time the time at which the scale apparently disappears. Subsequently, the cold-rolling was carried out. The sheet of the X group and Y group were cold-rolled to 0.23 mm and 0.18 mm, respectively. The sheets were immersed in an isothermal tank of 250° C. for 20 minutes in the course of cold-rolling to 0.17 mm, 0.12 mm, 0.07 mm, and 0.04 mm with regard to the X group and 1.1 mm, 0.07 mm, and 0.04 mm with regard to the Y group. After degreasing the rolling oil by trichloroethylene, the decarburization annealing was carried out at 800° C. for 300 seconds in a wet-hydrogen stream. After cooling down to room temperature, MgO was applied on the steel sheet. The steel sheets were then heated to 1200° C. at a temperature-elevation rate of 20° C. per hour, and then purification-annealed at 1200° C. for 25 hours. After furnace-cooling down to room temperature, the residual MgO was rinsed with water. Insulative tension coating, known from Japanese Examined Patent Publication No. 53-28375, was applied on the steel sheet. The insulative tension coating was baked while imparting the tension to the steel sheets. The coil set was removed simultaneously with the baking.

The magnetic properties of the steel sheets were measured. The tensional force of both the forsterite coating and the insulative coating was measured. After removal of these coatings, the macrostructures were investigated to determine the number of 2 mm or less circle-equivalent diameter grains, their proportion in total grains, and the average nearest intergrain distance of the 2 mm or less circle-equivalent diameter grains. Finally, the impurities of steel sheet were chemically analyzed.

The results are given in Table 2.

TABLE 2

| Symbol of Components | Components of Hot-rolled Strip | | | | | Degree of Pickling | Sheet Thickness of Product (mm) | Tensional Force of Film (kg/mm²) | Components of Product Si (%) | C (ppm) | N (ppm) | S (ppm) |
|---|---|---|---|---|---|---|---|---|---|---|---|---|
| A | Si | 3.6, | Mn | 0.08 | | U | X 0.23 | 0.67 | 3.48 | 8 | 10 | 10 |
| | C | 0.07, | S | 0.018 | | | Y 0.18 | 0.75 | 3.45 | 12 | 9 | 9 |
| | sol.Al | 0.029, | Sn | 0.12 | | V | X 0.23 | 0.35 | 3.52 | 18 | 14 | 12 |
| | N | 0.0080, | Cu | 0.12 | | | Y 0.18 | 0.42 | 3.50 | 14 | 12 | 12 |
| B | Si | 3.4, | Se | 0.015 | | U | X 0.23 | 0.48 | 3.27 | 6 | 8 | 11 |
| | C | 0.06, | Sb | 0.03 | | | Y 0.18 | 0.68 | 3.23 | 7 | 6 | 13 |
| | sol.Al | 0.025, | As | 0.008 | | V | X 0.23 | 0.65 | 3.29 | 10 | 11 | 8 |
| | N | 0.0085, | Sn | 0.023 | | | Y 0.18 | 0.72 | 3.30 | 9 | 7 | 8 |
| C | Si | 3.5, | Mn | 0.07 | | U | X 0.23 | 0.89 | 3.32 | 8 | 9 | 7 |
| | C | 0.08, | Se | 0.02 | | | Y 0.18 | 0.77 | 3.30 | 6 | 7 | 5 |
| | sol.Al | 0.031, | Sb | 0.02 | | V | X 0.23 | 0.66 | 3.35 | 15 | 8 | 12 |
| | N | 0.0055, | Bi | 0.015 | | | Y 0.18 | 0.25 | 3.40 | 12 | 11 | 9 |

| Symbol of Components | Components of Hot-rolled Strip | | | | | Degree of Pickling | Macro-formation: Proportion (%) of Number of Grains with d ≦ 2 mm | Macro-formation: $\overline{ND}$ (mm) | Magnetic Properties (T) $B_{10}$ | (W/kg) $W_{17/50}$ | Remarks |
|---|---|---|---|---|---|---|---|---|---|---|---|
| A | Si | 3.6, | Mn | 0.08 | | U | 30 | 3.8 | 1.94 | 0.83 | Invention |
| | C | 0.07, | S | 0.018 | | | 42 | 4.5 | 1.93 | 0.86 | |
| | sol.Al | 0.029, | Sn | 0.12 | | V | 75 | 1.7 | 1.88 | 1.05 | Comparative |
| | N | 0.0080, | Cu | 0.12 | | | 69 | 1.4 | 1.87 | 0.97 | |
| B | Si | 3.4, | Se | 0.015 | | U | 51 | 3.1 | 1.94 | 0.84 | Invention |
| | C | 0.06, | Sb | 0.03 | | | 47 | 5.2 | 1.93 | 0.87 | |
| | sol.Al | 0.025, | As | 0.008 | | V | 13 | 9.5 | 1.88 | 1.13 | Comparative |
| | N | 0.0085, | Sn | 0.023 | | | 56 | 1.7 | 1.87 | 0.94 | |
| C | Si | 3.5, | Mn | 0.07 | | U | 38 | 5.7 | 1.95 | 0.86 | Invention |
| | C | 0.08, | Se | 0.02 | | | 42 | 6.2 | 1.94 | 0.85 | |
| | sol.Al | 0.031, | Sb | 0.02 | | V | 15 | 9.8 | 1.87 | 1.08 | Comparative |
| | N | 0.0055, | Bi | 0.015 | | | 11 | 8.7 | 1.87 | 1.11 | |

EXAMPLE 2

The same experiments as the composition C and Group U were carried out except for an additional step directly after the decarburization-annealing. In the additional step, the steel sheets were held at 970° C. for 50 seconds in a furnace where a dry nitrogen protective atmosphere was established.

The magnetic properties of the products were:

| | $W_{17/50}$ (w/kg) | $B_{10}$ (T) | Percentage of 2 mm or less circle-equivalent diameter grain (%) | $\overline{ND}$ |
|---|---|---|---|---|
| X (0.23 mm) | 0.84 | 1.96 | 35 | 6.1 |
| Y (0.18 mm) | 0.83 | 1.96 | 38 | 6.5 |

From the comparison of this data with those of C component and U group of Example 1, it is apparent that $B_{10}$ is enhanced and $W_{17/50}$ is improved by heat-treating the decarburization-annealed sheet at a high temperature for a short period of time.

EXAMPLE 3

A number of 2.3 mm thick hot-rolled sheets containing 2.5% to 4.3% silicon, 0.04% to 0.09% carbon, 0.020% to 0.032% acid-soluble aluminum, 0.0050% to 0.0100% nitrogen, 0.050% to 0.150% manganese, 0.014% to 0.035% sulfur, 0.08% to 0.15% copper and 0.05% to 0.20% tin were prepared. The hot-rolled sheets were annealed by one of the following heat cycles: holding at 1150° C. for 30 seconds, then holding at 900° C. for 1 minute, and water-cooling down to 100° C. in 20 to 30 seconds; and holding at 1150° C. for 30 seconds, then holding at 900° C. for 1 minute, and air-cooling down to 100° C. in 60 to 70 seconds. The sheets were then cold-rolled down to 0.21 mm or 0.18 mm in five passes with or without intermediate heat-treatment.

In the case of heat-treatment, the steel sheet were immersed, three times, in an isothermal bath of 250° C. for 20 minutes. Subsequently, the decarburization annealing and application of annealing separator were carried out by a known manner. In the finishing annealing, the annealing atmosphere before the secondary recrystallization was 10% $N_2$—90% $H_2$ or 80% $N_2$—20% $H_2$. The tension coating known from Japanese Examined Patent Publication No. 53-28375 was applied on the steel sheets. Thus, grain-oriented silicon steel sheets were obtained.

The magnetic properties and the tension of steel sheets resulting from the surface coatings were measured. Subsequently, the surface coatings were removed by means of fluoric acid and nitric acid, and the $\overline{ND}$ and $\overline{SF}$ of crystal grains, which appear on the sheet surface, were measured by using an image-analyzing processor. The silicon, tin, carbon, nitrogen, and sulfur contents in the steel were measured. The results are given in Table 3.

TABLE 3

| Sample Nos. | Cooling Level | Sheet Thickness of Product (mm) | Heat Treatment between Passes | Atmosphere of Finishing Annealing | Components of Product Steels Si (%) | Sn (%) | C (ppm) | N (ppm) | S (ppm) | Tensional Force of Film (kg/mm²) | ND | $\overline{SF}$ | $B_{10}$ (T) | $W_{17/50}$ (W/kg) | Remarks |
|---|---|---|---|---|---|---|---|---|---|---|---|---|---|---|---|
| 1 | I | 0.21 | Yes | A | 3.35 | 0.08 | 14 | 8 | 4 | 0.55 | 2.8 | 0.40 | 1.94 | 0.85 | Invention |
| 2 | I | 0.21 | No | A | 3.35 | 0.15 | 13 | 9 | 5 | 0.70 | 4.9 | 0.65 | 1.88 | 1.18 | Comparative |
| 3 | I | 0.21 | Yes | A | 3.25 | 0.13 | 13 | 9 | 5 | 0.72 | 5.2 | 0.53 | 1.92 | 0.85 | Invention |
| 4 | I | 0.21 | Yes | B | 3.35 | 0.10 | 12 | 8 | 6 | 0.65 | 7.6 | 0.61 | 1.90 | 1.02 | Comparative |
| 5 | I | 0.18 | Yes | A | 3.45 | 0.14 | 12 | 7 | 5 | 0.77 | 3.5 | 0.50 | 1.94 | 0.83 | Invention |
| 6 | I | 0.18 | No | A | 3.35 | 0.09 | 14 | 8 | 5 | 0.63 | 8.3 | 0.63 | 1.89 | 1.04 | Comparative |
| 7 | I | 0.21 | Yes | A | 3.25 | 0.16 | 25 | 8 | 8 | 0.58 | 9.2 | 0.55 | 1.91 | 0.98 | Comparative |
| 8 | I | 0.21 | Yes | A | 3.15 | 0.12 | 14 | 10 | 5 | 0.66 | 4.3 | 0.50 | 1.93 | 0.84 | Invention |
| 9 | I | 0.21 | Yes | A | 3.35 | 0.09 | 13 | 17 | 26 | 0.72 | 5.3 | 0.53 | 1.89 | 0.97 | Comparative |
| 10 | II | 0.21 | Yes | A | 3.25 | 0.11 | 12 | 8 | 4 | 0.70 | 4.7 | 0.66 | 1.88 | 1.10 | Comparative |
| 11 | II | 0.18 | Yes | A | 3.15 | 0.12 | 12 | 8 | 7 | 0.81 | 5.8 | 0.62 | 1.89 | 1.08 | Comparative |
| 12 | II | 0.18 | Yes | A | 3.25 | 0.08 | 14 | 7 | 5 | 0.68 | 8.5 | 0.64 | 1.87 | 1.01 | Comparative |

Cooling Level
I. 20–30 seconds down to 100° C.
II. 60–70 seconds down to 100° C.
Heat Treatment between Passes: In three of five passes, immersion into an isothermal bath of 250° C. for 20 minutes
Atmosphere of Finishing Annealing (Before Secondary Recrystallization)
A. $N_2$ 10%, $H_2$ 90%
B. $N_2$ 80%, $H_2$ 20%

Sample Nos. 10, 11, and 12, in which the cooling time in the annealing of the hot-rolled sheets did not fall within the range of the present invention, exhibited an $\overline{SF}$ of more than 0.60 and high $W_{17/50}$. Samples Nos. 2 and 6, in which no heat-treatment between the cold-rolling passes was carried out, exhibited a great $\overline{SF}$. $W_{17/50}$ of Sample Nos. 2 and 6 exceeded the level of 0.88 w/kg. Sample No. 4 (80% $N_2$ and 20% $H_2$) did not attain an $\overline{SF}$ of 0.60 or less. Sample Nos. 7 and 9, in which the residual carbon, nitrogen, and sulfur contents exceeded the level of the present invention, attained an $\overline{SF}$ of 0.60 or less but exhibited a high $W_{17/50}$. Contrary to the above samples, Samples 1, 3, 5, and 8 according to the present invention attained $W_{17/50}<0.86$.

We claim:

1. A grain-oriented silicon steel sheet, containing from 2.3% to 4.3% of silicon and 0.0020% or less of each of carbon, nitrogen, and sulfur and having a sheet thickness of from 0.15 to 0.23 mm, wherein crystal grains having 2 mm or less circle-equivalent diameters are present in an amount of from 15% to 70% based on the total number of crystal grains; and, further an average nearest intergrain distance ($\overline{ND}$) of said crystal grains of 2 mm or less circle-equivalent diameter is from 2.0 to 8.0 mm ($\overline{ND}$=2.0 to 8.0 mm); $B_{10}\geqq 1.89$ T and $W_{17/50}\leqq 0.88$ w/kg.

2. A grain oriented silicon steel sheet according to claim 1, characterized in that the total crystal grains have a grain-boundary shape factor (SF) which average 0.60 or less, SF being defined by:

$$SF = \frac{4\pi \times (\text{area of crystal grain})}{(\text{length of crystal grain boundary})^2}.$$

3. A grain-oriented silicon steel sheet according to claim 1 or 2, having, in the steel sheet, residual tensional stress of from 0.20 to 1.0 kg/mm$^2$, measured before any stress-relief annealing.

* * * * *